US008288009B2

(12) United States Patent
Deniau et al.

(10) Patent No.: US 8,288,009 B2
(45) Date of Patent: Oct. 16, 2012

(54) FORMATION OF ULTRA-THIN FILMS THAT ARE GRAFTED TO ELECTRICALLY-CONDUCTING OR SEMI-CONDUCTING SURFACES

(75) Inventors: Guy Deniau, Auffargis (FR); Serge Palacin, Montigny le Bretonneux (FR)

(73) Assignee: Commissariat a l'Energie Atomique, Paris (FR)

( * ) Notice: Subject to any disclaimer, the term of this patent is extended or adjusted under 35 U.S.C. 154(b) by 1407 days.

(21) Appl. No.: 11/908,692

(22) PCT Filed: Mar. 13, 2006

(86) PCT No.: PCT/FR2006/000547

§ 371 (c)(1),
(2), (4) Date: Oct. 9, 2007

(87) PCT Pub. No.: WO2006/097611

PCT Pub. Date: Sep. 21, 2006

(65) Prior Publication Data

US 2008/0124832 A1 May 29, 2008

(30) Foreign Application Priority Data

Mar. 15, 2005 (FR) ..... 05 02516

(51) Int. Cl.
*B32B 27/32* (2006.01)
*B32B 27/00* (2006.01)
*B05D 3/02* (2006.01)

(52) U.S. Cl. ..... 428/500; 428/220; 428/332; 427/372.2

(58) Field of Classification Search ..... None
See application file for complete search history.

(56) References Cited

U.S. PATENT DOCUMENTS

| | | | | |
|---|---|---|---|---|
| 5,567,297 | A * | 10/1996 | Mertens et al. | 205/334 |
| 6,375,821 | B1 * | 4/2002 | Jerome et al. | 205/83 |
| 7,591,937 | B2 * | 9/2009 | Bureau et al. | 205/317 |
| 2007/0289872 | A1 * | 12/2007 | Deniau et al. | 205/157 |

FOREIGN PATENT DOCUMENTS

EP 0 665 275 8/1995

OTHER PUBLICATIONS

International Search Report for PCT/FR2006/000547 filed Mar. 13, 2006.

Database Compendex [Online] Engineering Information, Inc., New York, NY, US; 1992, Deniau G et al: "Comparative study of acrylonitrile, 2-butenenitrile, 3-butenenitrile, and 2-methyl-2-propenenitrile electropolymerization on a nickel cathode";XP002438463 & Langmuir; Langmuir Jan. 1992, vol. 8, No. 1, Jan. 1992, pp. 267-276, XP00243852& p. 267, left-hand column, paragraph 1 p. 268, left-hand column, paragraph 3—right-hand column, paragraph 1; figure 1 p. 271, right-hand column, paragraph 3—p. 272, right-hand column, paragraph 3 p. 273, right-hand column, paragraphs 1,2; figure 7 p. 275, right-hand column, paragraph 5 p. 276, left-hand column, paragraph 4-right-hand column, last paragraph.

Database Compendex [Online] Engineering Information, Inc., New York, NY, US; 1998, Deniau Guy et al: "Coupled chemistry revisited in the tentative cathodic electropolymerization of2-butenenitrile" XP002438464 Database accession No. EIX98394326552 cited in the application abstract &—J Electroanal Chem; Journal of Electroanalytical Chemistry Jul. 1, 1998, Elsevier Science S.A., Lausanne, Switzerland, vol. 451, No. 1-2, Jul. 1, 1998, pp. 145-161,XP002438472 p. 145, left-hand column, paragraph 1 p. 146, right-hand column, paragraphs 1,3,4—p. 147, left-hand column p. 153, left-hand column, paragraph 2 p. 156, left-hand column, paragraph 1 p. 157, right-hand column—p. 158, right-hand column, paragraph 1 figure 15 p. 160, left-hand column, paragraph 2—p. 161, left-hand column.

Database CA [Online] Chemical Abstracts Service, Columbus, OH, US; 1991, Hennico, G. et al: "Preliminary theoretical study of acrylonitrile and its methyl derivatives as monomers for cathodic electropolymerization" XP002344716 retrieved from STN Database accession No. 116:6997 cited in the application abstract—& International Journal of Quantum Chemistry, Quantum Chemistry Symposium, 25, 507-26 CODEN: IJQSDI; ISSN: 0161-3642, 1991, XP002438473.

* cited by examiner

*Primary Examiner* — Sheeba Ahmed
(74) *Attorney, Agent, or Firm* — Alston & Bird LLP

(57) ABSTRACT

The present invention relates to the use of precursors of following formula (I):

(I)

independently of E or Z configuration, in which:

$R_2$ is an electron-withdrawing group, $R_1$, $R_3$, $R_4$ and $R_5$, which are identical or different, represent a hydrogen atom, an alkyl radical or an aryl radical, in the formation, by electrochemical grafting, of a homogeneous organic film, preferably with a thickness of less than or equal to 10 nm, on an electrically conducting or semiconducting surface; and to the corresponding process for the formation of an ultrathin homogeneous organic film on an electrically conducting or semiconducting surface.

23 Claims, 6 Drawing Sheets

FORMATION OF ULTRA-THIN FILMS THAT ARE GRAFTED TO ELECTRICALLY-CONDUCTING OR SEMI-CONDUCTING SURFACES

CROSS REFERENCE TO RELATED APPLICATIONS

This application is a national stage application filed under 35 USC 371 of International Application No. PCT/FR2006/000547, filed Mar. 13, 2006, which claims priority from French patent application 05 02516 filed Mar. 15, 2005.

FIELD AND BACKGROUND OF THE INVENTION

The present invention relates to the field of organic surface coatings, the said coatings being in the form of organic films. It relates more particularly to the use of a family of molecules suitably selected in order to make possible the simple and reproducible formation of ultrathin organic films (that is to say, the thickness of which is generally less than about ten nanometers or composed only of a few monomeric layers) by electrochemical grafting to electrically conducting or semi-conducting surfaces.

There currently exists several techniques which make it possible to prepare thin organic films on substrates, each being based on an appropriate family or class of molecules.

The processes for forming a coating by centrifuging, known under the term of "spin coating" (or the related techniques for forming coatings by immersion (dip coating) or by deposition by spraying (spray coating)) do not require a particular affinity between the molecules deposited and the substrate of interest. This is because the cohesion of the deposited film is based essentially on the interactions between the constituents of the film, which can, for example, be crosslinked after deposition in order to improve the stability thereof. These techniques are highly versatile, can be applied to all types of surfaces to be covered and are highly reproducible. However, they do not make possible any effective grafting between the film and the substrate (simple physisorption is involved) and the thicknesses produced are always greater than about ten nanometers. Moreover, the spin coating techniques only make possible uniform deposited layers when the surface to be covered is essentially flat (French Patent Application FR-A-2 843 757). The minimum thicknesses accessible to the spray coating techniques are related to the wetting of the surfaces by the sprayed liquid, since the deposited layer only becomes essentially film-forming when the drops coalesce. Finally, the thickness of the deposited layers obtained by dip coating depends in a rather complex fashion on a certain number of parameters, such as the viscosity of the dipping liquid, and on the process (withdrawal rate).

Other techniques for forming an organic coating at the surface of a support, such as plasma deposition, for example described in the papers by Konuma M., "*Film deposition by plasma techniques*", (1992) Springer Verlag, Berlin, and by Biederman H. and Osada Y., "*Plasma polymerization processes*", 1992, Elsevier, Amsterdam, or else photochemical activation, are based on the same principle: generating unstable forms of a precursor close to the surface to be covered, which unstable forms change with the formation of a film on the substrate. While plasma deposition does not require any specific property of its precursors, photoactivation for its part requires the use of photosensitive precursors, the structure of which changes under irradiation with light.

These techniques generally give rise to the formation of adherent films, although it is generally impossible to discern whether this adhesion is due to crosslinking of a film topologically closed around the object or to true formation of bonds at the interface.

The self-assembling of monolayers is a technique which is very simple to employ (Ulman A., "*An introduction to ultrathin organic films from Langmuir-Blodgett films to self-assembly*", 1991, Boston, Academic Press). However, this technique requires the use of generally molecular precursors having a sufficient affinity for the surface of interest to be coated. The term used will then be "precursor-surface pair", such as sulphur compounds having affinity for gold or silver, trihalosilanes for oxides, such as silica or alumina, or polyaromatics for graphite or carbon nanotubes. In all cases, the formation of the film is based on a specific chemical reaction between a part of the precursor molecule (the sulphur atom in the case of the thiols, for example) and certain "receptor" sites of the surface. A chemisorption reaction provides the attachment. Thus, at ambient temperature and in solutions, films with the thickness of a molecule (less than 10 nm) are obtained. However, while the pairs involving oxide surfaces give rise to the formation of very firmly grafted films (the Si—O bond involved in the chemisorption of trihalo-silanes on silica is among the most stable in chemistry), this is not at all the case when oxide-free metals or semiconductors are involved. In these cases, the interfacial bonding between the conducting surface and the monomolecular film is weak. Thus, the self-assembled monolayers of thiols on gold desorb as soon as they are heated above 60° C. or in the presence of a good solvent at ambient temperature or as soon as they are brought into contact with an oxidizing or reducing liquid medium. Similarly, Si—O—Si bonds are weakened immediately they are in an aqueous medium, indeed even a humid medium, in particular under the effect of heat.

The electrografting of polymers is a technique based on the initiation and then the polymerization, by chain propagation, which is electroinduced of electroactive monomers on the surface of interest, which acts both as electrode and as polymerization initiator (S. Palacin et al., "*Molecule-to-metal bonds: electrografting polymers on conducting surfaces*", *ChemPhysChem*, 2004, 10, 1468). Electrografting requires the use of precursors suited to its mechanism of initiation by reduction and of propagation, generally anionic, as preference is often given to cathodically initiated electrografting, which can be applied to noble and non-noble metals (in contrast to electrografting by anodic polarization, which can be applied only to noble substrates). "Depleted vinyl" molecules, that is to say vinyl molecules carrying electron-withdrawing functional groups, such as acrylonitriles, acrylates, vinylpyridines, and the like, are particularly suitable for this process, which gives rise to numerous applications in the field of microelectronics or the biomedical field. The adhesion of the electrografted films is provided by a carbon-metal covalent bond. However, the polymerizable nature of the precursor results in relatively thick electrografted films, that is to say having a thickness rarely of less than 50 nm.

According to this electrografting technique, the polymerization is essential for the formation of the carbon/metal interfacial bond: this is because it has been shown (G. Deniau et al., "*Coupled chemistry revisited in the tentative cathodic electro-polymerization of* 2-*butenenitrile*", Journal of Electro-analytical Chemistry, 1998, 451, 145-161) that the mechanism of electrografting proceeds by an electro-reduction of the monomer on the surface to give an unstable radical anion which, if it were not in the middle of polymerizable molecules, would desorb to return into solution (op.cit.).

Aside from this desorption reaction, the addition reaction (of Michael addition type) of the charge of the first chemisorbed radical anion to a free monomer offers a second means of stabilizing the reaction intermediate: the product of this addition again gives a radical anion, where the charge has, however, "moved away" from the surface, which contributes to stabilizing the adsorbed structure. This dimeric radical anion can itself again add to a free monomer, and so on: each new addition is an additional stability by relaxation of the charge/polarized surface repulsion, which amounts to saying that the interfacial bond of the first radical anion, which is temporary, becomes stable as the polymerization takes place. In other words, it has been put forward that a vinyl monomer which cannot polymerize cannot be electrografted.

Among the various techniques recalled above, electrografting is the only technique which makes it possible to produce grafted films with specific control of the interfacial bonding. Moreover, contrary to the plasma or photoinduced techniques, electrografting only generates its reactive entities in the immediate vicinity of the surface of interest (in the electrochemical double layer, the thickness of which is a few nanometers in the majority of cases).

It appears to be accepted today that the production of grafted polymer films by electrografting activated vinyl monomers to conducting surfaces proceeds by virtue of electroinitiation of the polymerization reaction starting from the surface, followed by growth of the chains monomer by monomer. The reaction mechanism for electrografting has in particular been described in the papers by C. Bureau et al., Macro-molecules, 1997, 30, 333; C. Bureau and J. Delhalle, Journal of Surface Analysis, 1999, 6(2), 159 and C. Bureau et al., Journal of Adhesion, 1996, 58, 101.

By way of example, the reaction mechanism for the electrografting of acrylonitrile by cathodic polarization can be represented by the following Scheme A:

In this scheme, the grafting reaction corresponds to stage 1, where growth takes place starting from the surface. Stage 2 is the main side reaction, which results in the production of an ungrafted polymer; this reaction is limited by the use of high concentrations of monomer.

The grafted chains thus grow by purely chemical polymerization, that is to say independently of the polarization of the conducting surface which gave rise to the grafting. This stage is thus sensitive to (and is in particular interrupted by) the presence of chemical inhibitors of this growth, in particular by protons.

In Scheme A above, where the electrografting of acrylonitrile under cathodic polarization was considered, the growth of the grafted chains takes place by anionic polymerization. This growth is interrupted in particular by protons and it has even been shown that the content of protons constitutes the major parameter which controls the formation of polymer in solution; the information obtained during synthesis, in particular the appearance of the voltamogrammes which accompany the synthesis, show it (see in particular the paper by C. Bureau, Journal of Electro-analytical Chemistry, 1999, 479, 43). Traces of water and more generally the labile protons from protic solvents constitute sources of protons which are harmful to the growth of the grafted chains.

The majority of vinyl compounds can be successfully grafted to conducting surfaces. However, it has been shown that it is impossible to form films starting from some vinyl compounds; more particularly, it has proved impossible, to date, to produce grafted polymers starting from crotononitrile.

One explanation for this reaction being impossible was put forward in the abovementioned paper by G. Deniau et al., J. Electroanal. Chem., 1998. This is because it has been shown that the —$CH_3$ group of 2-butenenitrile (or crotononitrile), positioned in the cis or trans position with respect to the driving electron-withdrawing nitrile group, experiences a

SCHEME A

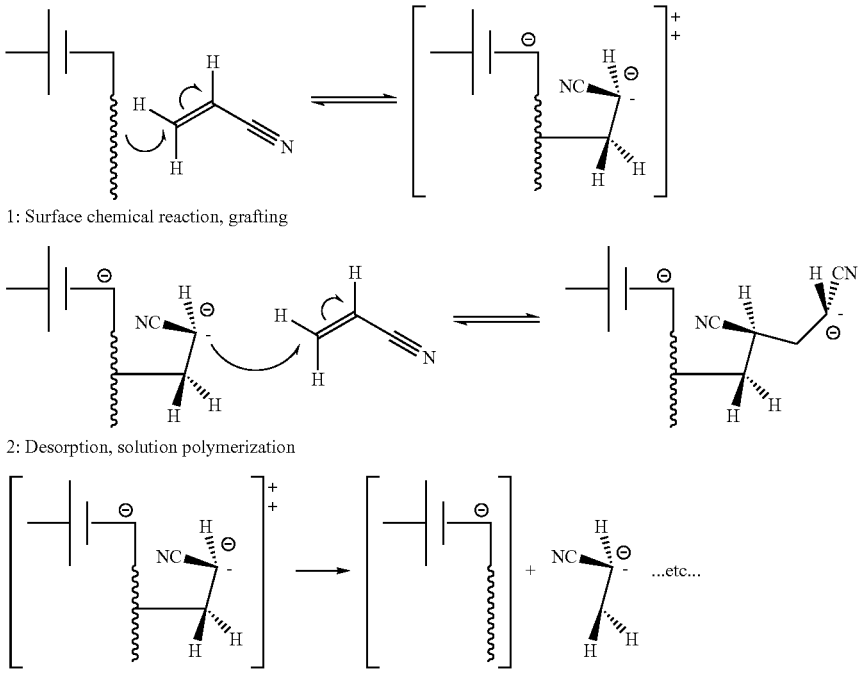

strong reduction in its pKa in comparison with that of the protons of the —$CH_3$ group of methylpropenenitrile. In the case of methacrylonitrile, where the electron-withdrawing —$CH_3$ and —CN radicals are carried by the same carbon atom, a conventional pKa of the order of 30 is observed in acetonitrile, indicating protons of very low acidity.

Thus, the pKa values of the —$CH_3$ radicals for crotononitrile and methacrylonitrile were respectively calculated, in acetonitrile, according to the following reactions (1) and (2):

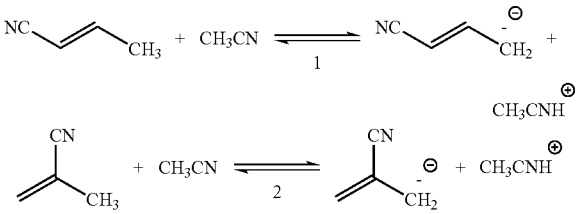

The results are given in Table I below:

TABLE I

| Reaction No. | $\Delta G/kJ \cdot mol^{-1}$ | Calculated pKa |
|---|---|---|
| 1 | +110 | 19.1 |
| 2 | +184 | 32.1 |

These results unambiguously show that the protons of the —$CH_3$ radical of crotononitrile make this molecule a weak acid, within the Brönsted sense, in acetonitrile and give an explanation for the nonpolymerization observed experimentally for this molecule.

Thus, in the case illustrated in the following reactions (3) and (4), it is observed, after the electrochemical reduction (reaction 3), that the radical anion formed reacts in solution with the acidic proton of a neutral molecule (reaction 4):

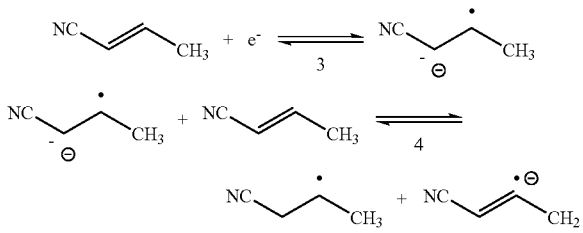

The overall reactivity of crotononitrile and of its radical anion formed after reduction is described in the paper by Deniau G. et al., 1998 (abovementioned), where it appears the crotononitrile does not make it possible to produce electrografted organic films.

Likewise, at the surface, the mechanism represented in the following Scheme B has been proposed, by analogy with what has been established for methacrylonitrile:

SCHEME B

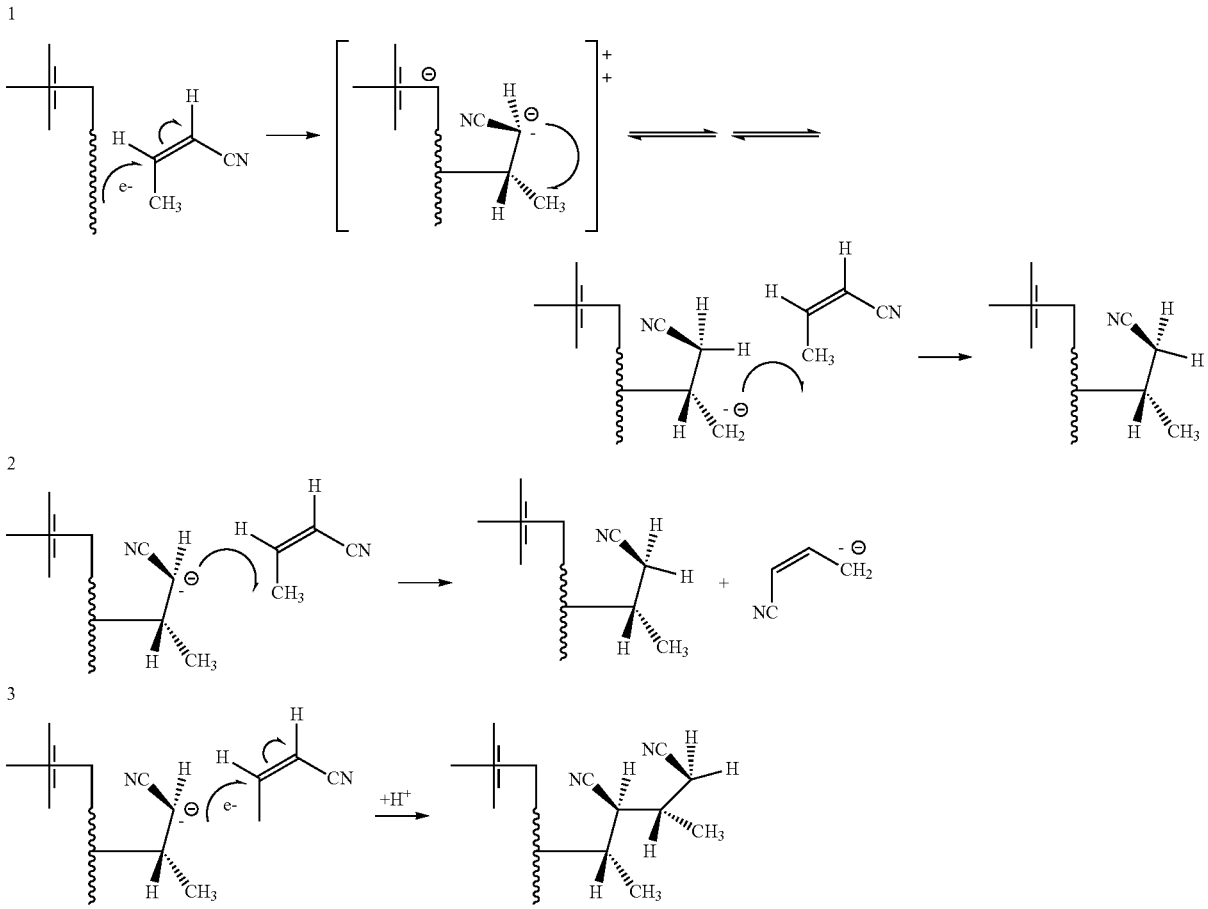

In this scheme, after the reaction of grafting to the surface, the anion heals not by a reaction of Michael type, as for methacrylonitrile (anionic propagation of the polymerization, as appears in Scheme A above), but by capturing an acidic proton from a neutral molecule.

In this Scheme B, reaction (1) reflects the possible tautomerism of the —$CH_3$ radical of the grafted radical anion which can result in the following anion:

Surface-CH(—$CH_2^-$)—$CH_2CN$

It is only in water that the mobility of the protons is very substantially different from that of the other cations as the proton "does not move". In organic solvents, it is a nucleus like others which has to actually move, and it makes sense to distinguish between an intra- and intermolecular proton transfer. This mechanism is therefore only possible in the case of molecules having an intramolecular proton.

Reaction (2) of Scheme B results in the same product but directly via an intermolecular route due to the relative acidity of the protons of the crotononitrile.

Overall, if it is therefore known how to produce chemical bonds on conducting or semiconducting substrates by electrografting various precursors, it remains difficult to obtain, by virtue of these reactions, ultrathin films approaching the monolayer (thickness<10 nm) as the underlying reaction mechanisms do not make it possible to satisfactorily control at scales of a nanometer or less. To date, only aryldiazonium salts have made possible a solution approach to this problem.

Thus, as disclosed, for example, in French Patent Application FR-A-2 804 973, the electrografting of precursors, such as aryldiazonium salts, which carry a positive charge takes place by virtue of a reaction for cleaving the salts in their reduced form to give a radical which is chemisorbed on the surface. Just as for the electrografting of the polymers, the reaction for the electrografting of aryldiazonium salts is electroinitiated and results in the formation of interfacial chemical bonds. Unlike the electrografting reactions of polymers, the electrografting of aryldiazonium salts does not "need" a coupled chemical reaction to stabilize the chemisorbed entity formed subsequent to the charge transfer as this entity is electrically neutral and not negatively charged, as in the case of a vinyl monomer. It thus results a priori in a stable surface/aryl group adduct.

However, it has been demonstrated, in particular in French Patent Application FR-A-2 829 046, that aryl-diazonium salts result in ultrathin organic films which are electrically conducting and which can thus grow on themselves: once the grafting to the initial surface has been carried out by an electrocleavage reaction+chemisorption, the film grows by an electro-controlled reaction in the manner of a conducting polymer film but at the cathode. This makes it difficult to control the thicknesses of the organic films resulting from the electrografting of aryldiazonium salts, in particular in the very low ranges of thickness, that is to say below 100 nm and in particular below 20 nm.

For the purpose of aiming at monolayers of aryl groups starting from aryldiazonium salts, the proposal has been made to limit the growth of the chains by minimizing the formation of radicals in the vicinity of the surface of the electrode by adding radical scavengers (James Tour et al., J. Am. Chem. Soc., 2004, 126, 370-378). As the growth of the film on itself is intrinsically a reaction with second order kinetics with respect to the concentration of aryl radicals, whereas the chemisorption and grafting reaction is first order with respect to the same concentration, it is then understood that the decrease in this concentration is in favour of better selectivity for the grafting at the expense of the growth.

However, it is generally observed that it is the combined kinetics which are first slowed down and advantageous degrees of coverage are then only obtained for very long times compatible with difficulty with a large number of industrial applications.

By extension, the addition of scavengers of growing ends for other monomeric substrates might be envisaged as a means of very rapidly terminating the growth in order to produce very short chains and thus to control at low thicknesses. Nevertheless, the concentration ratio of the "propagators" (monomers) to the growth "inhibitors" generally results only in random controlling of the lengths of growing chains, worthwhile with large numbers (i.e., high degrees of polymerization) but not in a position to provide a sufficiently precise parameter for control of the lengths of chains resulting in ultrathin layers (less than or equal to 10 nm).

Furthermore, the one-to-one relationship between thickness and length of chains is improper: the grafting density of the chains, which gives the number of bases of chains per unit of surface area, also has to be known in order for the relationship to be effectively one-to-one. This is because it is possible to produce a given thickness either with very dense chains (close packing), by controlling solely the length of the chains as a brush, but also at a given (possibly high) chain length by controlling the grafting density (at low density, the chains are "flattened" on the surface and give an apparent thickness which is lower than the chain length). Controlling the length of growing chains, without further reflections, is thus generally insufficient to control the thickness of the film obtained.

SUMMARY OF THE INVENTION

Mention may in particular be made, among the industries concerned with ultrathin films, of those of microelectronics. Current processes for the manufacture of microprocessors are based on the deposition of successive very fine layers optionally apertured by lithography so as to obtain selective deposited layers, both for the manufacture of transistors and for that of the copper interconnecting networks between these transistors. The race for high speeds for processors leads to miniaturization of the architecture of the combined components, with the result that the successive layers which give rise to them are themselves increasingly thin. The challenge is clearly today to industrially produce, over tens of square kilometers per week, layers of less than 10 nanometers with a control of uniformity at better than 5%.

The electrografting reactions currently available according to the prior art make it possible to easily obtain organic films with thicknesses of between 10 and 500 nm on varied conducting and semiconducting substrates. Nevertheless, it remains to widen the range of thicknesses, both towards thicker layers (>10 micrometers) and thinner layers (fractions of a nanometer), in order to respond to the demands of the industry and to vary the operating properties of such materials and thus their applicational potentialities.

There thus exists a technical problem related to the production of ultrathin films (that is to say, the thickness of which is less than approximately 10 nanometers or composed solely of a few monomeric layers and thus necessarily highly controlled/controllable) which are firmly bonded to electrically conducting or semiconducting surfaces, which problem cannot be satisfactorily solved by any existing technique, in order to furthermore envisage manufacture on the industrial scale.

It is thus in order to overcome this technical problem that the inventors have developed that which forms the subject-matter of the present invention.

The inventors have in particular found, surprisingly and contrary to what was previously accepted in the prior art, that it is possible to produce homogeneous and ultrathin organic films, that is to say with a thickness of less than or equal to 10 nm, on electrically conducting or semiconducting surfaces in a simple way which can be operated industrially by using certain selected molecules comprising both a polymerization-promoting radical and a polymerization-inhibiting radical. This technical change forms the basis of the present invention.

Within the meaning of the present invention, a film is said to be "organic" if the grafting process by which it can be obtained involves an electrochemical reaction carried out on a compound having an electrograftable carbon represented diagrammatically by the arrow C in the compound below and an electroreducible functional group represented diagrammatically by the arrow F in the compound below:

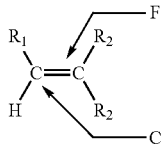

Furthermore, within the meaning of the present invention, a film is said to be "homogeneous" when the greatest distance measurable at the surface of an uncovered region is less than or equal to the mean length of the grafted chains. As emerges from the examples below, this homogeneity can be measured by ultraviolet photoelectron spectroscopy (UPS).

According to a first subject-matter, the present invention relates to the use of organic precursors of following formula (I):

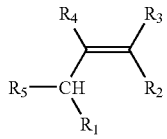

(I)

independently of E or Z configuration, in which:

$R_2$ is an electron-withdrawing group, $R_1$, $R_3$, $R_4$ and $R_5$, which are identical or different, represent a hydrogen atom, an alkyl radical or an aryl radical, in the formation, by electrochemical grafting, of a homogeneous organic film on an electrically conducting or semiconducting surface.

According to a specific and preferred embodiment of the invention, the organic film thus formed has a thickness of less than or equal to 10 nm.

Within the meaning of the present invention, the term "electron-withdrawing group" is understood to mean any group capable of stabilizing an anion in the α position with regard to this group, it being possible for the stabilization to be achieved by delocalization of the electrons (mesomeric effect -M) or by a simple electron-attracting effect (—I) or alternatively by cleavage of a bond (electrocleavable group).

Mention may in particular be made, as electron-withdrawing group, of the groups or functional groups capable of stabilizing the anion by a mesomeric effect, such as the carbonyl, sulphonyl, amide, nitrile, nitro, ester, carboxylic acid, acid halide, acid anhydride, aryl and heteroaryl groups; the groups or functional groups capable of stabilizing the anion due to their electronegativity (electron-attracting groups), such as the halogen atoms, silanes and haloalkyls; the electrocleavable groups which stabilize the anion by cleavage of a bond, such as the epoxides, triflates and quaternary ammoniums, and, finally, the mixed groups or functional groups which stabilize the anion by several effects, such as, for example, the nitrites, which are electronegative and make possible a mesomeric effect.

Within the meaning of the present invention, an "alkyl radical" refers to a saturated or unsaturated, linear, branched or cyclic, optionally mono- or polysubstituted alkyl group comprising from 1 to 20 carbon atoms, it being possible for the said radical to comprise one or more heteroatoms, such as N, C or S. Mention may in particular be made, among such alkyl radicals, without implied limitation, of the methyl, propyl, isopropyl, butyl, sec-butyl, tert-butyl and pentyl radicals.

Still within the meaning of the present invention, an aryl radical refers to a substituted or unsubstituted, aromatic or heteroaromatic carbon structure composed of one or more aromatic or heteroaromatic rings each comprising from 3 to 8 atoms.

Mention may in particular be made, among the substituents of the alkyl and aryl radicals, without implied limitation, of halogen atoms and alkyl, haloalkyl, substituted or unsubstituted aryl, substituted or unsubstituted heteroaryl, amino, cyano, azido, hydroxyl, mercapto, keto, carboxyl and methoxy groups.

The choice of the substituents is based on the following principle: the control of the thickness of an electrografted film supposes that the grafted entity immediately after the charge transfer from the electrode is stable with regard to the medium from which it results. As indicated above, the reactions for grafting and growing polymer by electroinitiation (cathodic) are closely related: it is the growth of the polymer which stabilizes the grafting (the metal-polymer bond) by distancing the carbanion from the negatively charged metal surface (see Scheme A above) In order to limit the growth reaction and to retain the grafting reaction, the inventors have selected the compounds of formula (I) above which have an electroreducible (graftable) functional group and a functional group which is sufficiently acidic to inhibit the anionic polymerization growth reaction.

The invention generally corresponds to precursor molecules of films, the single-electron reduction of which results in a stable or stabilized entity by a faster reaction than the propagation of a polymer chain and than the desorption of this grafted entity. The use of the compounds of formula (I) in accordance with the invention also makes it possible to obtain an electrografted organic film, the thickness and the grafting density of which can be controlled.

According to a preferred embodiment of the invention, $R_2$ is a nitrile or carbonyl group. When $R_2$ represents a carbonyl group, the latter is then preferably chosen from esters, carboxylic acids, acid halides and acid anhydrides.

Mention may in particular be made, as preferred examples of precursors of formula (I), of crotononitrile, pentanenitrile, ethyl crotonate and their derivatives. The derivatives of the compounds cited above correspond to the molecules which retain the parts necessary for the grafting. Thus, among the derivatives of ethyl crotonate, it is possible to envisage other compounds, such as esters, the corresponding acid or an amino acid bonded via its amine functional group, easily accessible by simple chemical reactions known to a person skilled in the art.

Another subject-matter of the invention is a process for the formation of a homogeneous organic film on an electrically conducting or semiconducting surface, the said process being characterized in that an electrolytic solution composed of at least one solvent and comprising at least one compound of following formula (I):

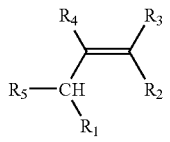

(I)

independently of E or Z configuration, and in which $R_1$, $R_2$, $R_3$, $R_4$ and $R_5$ are as defined above, is electrolysed on the said electrically polarized surface at least a working potential which is more cathodic than the electroreduction potential of at least one of the said precursors of formula (I), the said potentials being measured with respect to the same reference electrode, until a homogeneous electrografted organic film is obtained.

According to a specific and preferred embodiment of the invention, the said organic film exhibits a thickness of less than or equal to 10 nm.

According to a preferred embodiment of the invention, the precursors of formula (I) are chosen from the compounds for which the pKa of the hydrogen of the carbon carrying $R_1$ and $R_5$ is less than the pK of the solvent of the electrolytic solution, K being the autoprotolysis constant of the solvent.

In a nonexhaustive manner, use may be made, among the electrically conducting or semiconducting surfaces, of a surface composed of at least one of the following conductors or semiconductors: stainless steel, steel, iron, copper, nickel, cobalt, niobium, aluminium, silver, titanium, silicon, titanium nitride, tungsten, tungsten nitride, tantalum, tantalum nitride or a noble metal surface composed of at least one metal chosen from gold, platinum, iridium and platinum iridium. According to the preferred embodiment of the invention, the surface employed is a nickel surface.

According to the invention, it is preferable for the working potential employed to be at most greater by 5% than the value of at least one of the reduction potentials of the said precursors of formula (I) present in the electrolytic solution. This is because, in order to promote the surface reaction, it is advantageous to be situated at a value close to the threshold for reduction of the compound which will react at the surface.

According to another preferred embodiment of the process in accordance with the invention, the working current density is low, preferably less than or equal to $10^{-4}$ $A \cdot cm^{-2}$ approximately, so that most of the current is converted in the surface reaction and does not promote a side reaction in solution. An optimum value can be estimated from the mean number of grafting sites on the surface under consideration.

The electrolysis of the electrolytic solution including the compounds of formula (I) can be carried out independently by polarization under linear or cyclic voltammetry conditions, under potentiostatic, potentiodynamic, galvanostatic or galvanodynamic conditions or by simple or pulse chronoamperometry. Advantageously, it is carried out by polarization under cyclic voltammetry conditions. In this case, the number of cycles will preferably be between 1 and 1000 and more preferably still between 1 and 50.

In the electrolytic solution, the concentration of the precursor or precursors of formula (I) is preferably between 0.001 and 10 $mol \cdot l^{-1}$ approximately. Advantageously, this concentration is 5 $mol \cdot l^{-1} \pm 1$ $mol \cdot l^{-1}$ approximately.

The thickness of the film formed on the electrically conducting or semiconducting surface is controlled by the simple variation in the experimental parameters accessible empirically to a person skilled in the art depending on the precursor or precursors of formula (I) which is/are employed. Thus, nonexhaustively, the thickness of the film can be controlled by the number of scans in the case of cyclic voltammetry. Preferably, the number of scans will be between 2 and 20 in order to obtain a film thickness of between 1 and 3 monomers, i.e. between 0.2 and 0.5 nm. The thickness can also be controlled by the initial concentration of electroactive entities (precursors of formula (I)), the value of the maximum potential imposed and the polarization time, it being possible for the latter to vary either directly, this is the time for an electrolysis, or via a scan rate in voltammetry.

Preferably, the process in accordance with the present invention comprises an additional stage of functionalization of the electrografted organic film. This functionalization stage can be carried out after or during the grafting, if the chemistry allows it. Within the meaning of the present invention, the term "functionalization" denotes the chemical modification of the functional groups which the compounds of formula (I) possess. It can thus concern the modification of simple substituents, for example ester functional groups, or alternatively the complexing of metals, and the like, all this in order for the film obtained, and more particularly its surface, to ideally correspond to the expectations of its users. The derivatives of the compounds of formula (I) are therefore advantageous in so far as they retain their ability to be grafted according to the invention and carry substituents specific to their future use.

The solvents of the electrolytic solution are preferably chosen from dimethylformamide, ethyl acetate, acetonitrile, dimethyl sulphoxide and tetra-hydrofuran.

The electrolytic solution can additionally include at least one supporting electrolyte which can be chosen in particular from quaternary ammonium salts, such as quaternary ammonium perchlorates, tosylates, tetrafluoroborates, hexafluorophosphates or halides, sodium nitrate and sodium chloride.

Mention may in particular be made, among these quaternary ammonium salts, by way of examples, of tetraethylammonium perchlorate (TEAP), tetrabutyl-ammonium perchlorate (TBAP), tetrapropylammonium perchlorate (TPAP) or benzyltrimethylammonium perchlorate (BTMAP).

Another subject-matter of the invention is the electrically conducting or semiconducting surfaces obtained by carrying out the process described above, characterized in that the said surfaces comprise at least one face at least partially covered with an electrografted homogeneous organic film of at least one precursor of formula (I) as defined above.

The thickness of the films obtained according to the invention is advantageously between 1 and 15 monomers resulting from at least one compound of formula (I) and preferably approximately two. The films obtained according to the invention advantageously have a thickness of less than or equal to 10 nm and more preferably still of between 0.2 and 2.5 nm.

In a nonexhaustive fashion, the surfaces thus obtained according to the invention can advantageously be used in the electronics and microelectronics industries (for the preparation of microelectronic components) or for the preparation of biomedical devices, such as, for example, devices which can be implanted in the body (stents, for example), screening kits, and the like.

BRIEF DESCRIPTION OF THE DRAWINGS

In addition to the preceding provisions, the invention also comprises other provisions which will emerge from the description which will follow, which refers to examples of the preparation of organic coatings based on precursors of formula (I) at the surface of solid supports and to the appended FIGS. 1 to 12, in which.

PRELIMINARY EXAMPLE

Figure 1:
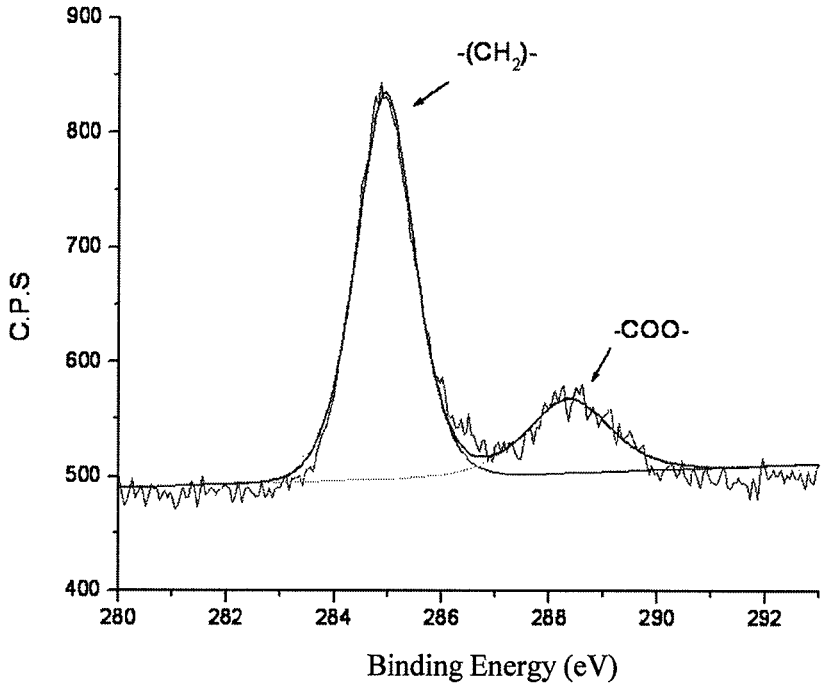
FIG. 1 represents the X-ray photoelectron spectroscopy (XPS) spectrum of the C 1s region of a reference nickel surface before any electrografting operation; the said spectrum corresponds to the number of counts per second (C.P.S.), expressed in arbitrary units (a.u.), as a function of the binding energy in electron-volts (eV)

The grafting experiments illustrated in the following examples were carried out on nickel electrodes (Ni layer obtained by radiofrequency cathodic sputtering) and starting from commercial electrolytic solutions (non-dehydrated and undistilled). In view of the thinness of the organic films expected, a preliminary study on virgin substrates was carried out by XPS spectroscopy. The results obtained are represented in the appended FIG. 1, in which the number of counts per second (C.P.S. or counts) expressed in arbitrary units (a.u.), is a function of the binding energy in electron-volts (eV). Ni and its conventional contaminants: the oxide NiO, and organic compounds of fatty acid type, are found in the overall spectrum.

In this figure, when the C 1s region is shown in detail, at approximately 285 eV, the trace of fatty acid —$(CH_2)_n$—COOH is actually found.

The total area of the C 1s signal represents 610 (in arbitrary units). This envelope can be broken down into two peaks. One is centred on 285.0 eV and represents carbon atoms in a neutral environment (—$(CH_2)_n$— type) and the second is shifted towards high binding energies (approximately 288.4 eV), which reflects an electro-negative environment for the probed atoms which is fully in agreement with groups of —COOR or —COOH type indicative of the presence of fatty acid.

Example 1

Synthesis of an Ultrathin Organic Film Grafted to a Nickel Substrate Starting from Crotono-Nitrile In this example, an electrolytic solution composed of acetonitrile and comprising crotononitrile (5 mol·$l^{-1}$) and TEAP as supporting electrolyte in a proportion of $5\times10^{-2}$ mol·$l^{-1}$ was electrolysed in a conventional three-electrode electrolysis cell. The working electrode is a layer of nickel supported by a glass slide, the counterelectrode is a platinum sheet and the reference electrode is based on the $Ag^+$/Ag couple.

The working electrode was subjected to cyclic voltammetry (10 cycles) between the equilibrium potential of the system (situated at approximately −0.6 and −2.4 V/($Ag^+$/Ag)) and a variable switching potential; at a scan rate of 50 mV/s. After the electrochemistry, the surfaces were rinsed with acetone and analysed by XPS and by infrared reflection-absorption spectroscopy (IRRAS). The XPS and IRRAS results are presented respectively in the appended FIGS. 2 and 3.

Figure 2:
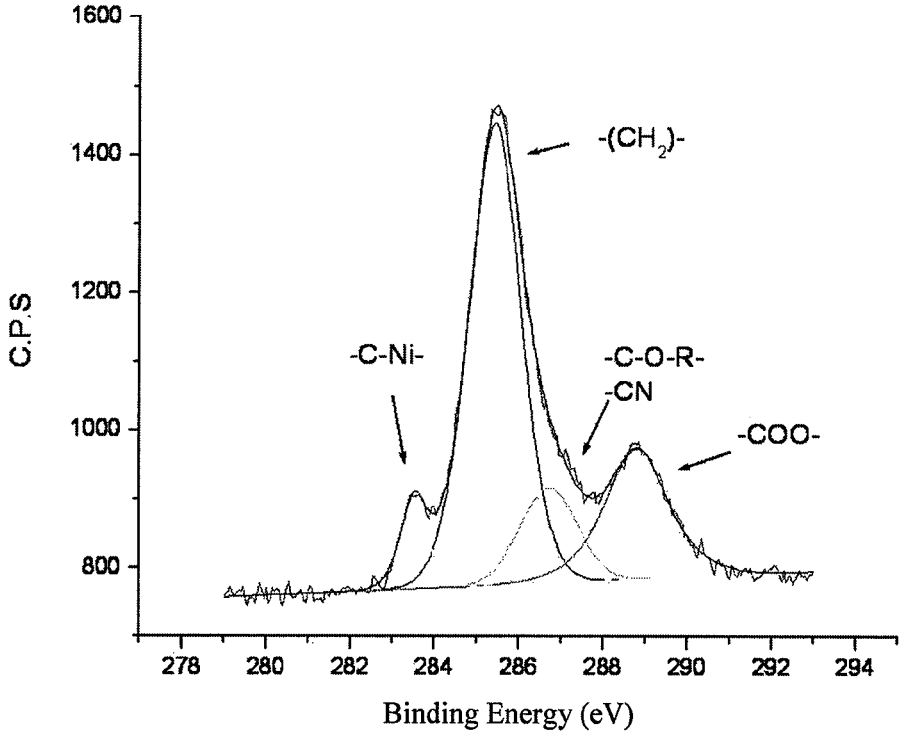
FIG. 2 (same units as FIG. 1) represents the XPS spectrum of the region of the C 1s levels recorded on a nickel substrate after formation of an organic film from an electrolytic solution including crotononitrile.

1) XPS Analysis (FIG. 2)

In this figure, it is found that the first peak is centred on 283.5 eV. Its mid-height width is 0.8 eV and it represents, by area, 6.2% of the total C 1s envelope. This peak is assigned to the carbon atoms chemically bonded to the metal atoms. The presence of this peak proves the electrochemical grafting of the crotononitrile molecule to the nickel surface.

Figure 10:
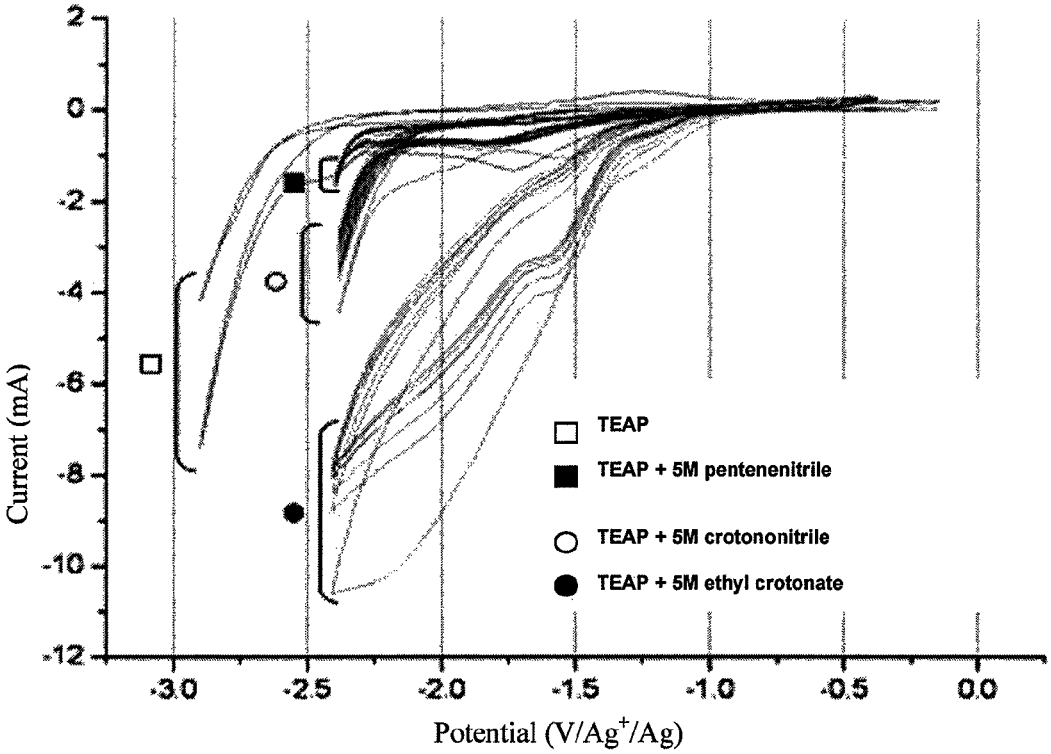
FIG. 10 (current in mA as a function of the potential V) represents a voltammogram (cyclic voltammetry; 10 cycles) recorded for the various molecules studied (crotononitrile, ethyl crotonate or cis-pentenenitrile), in the presence of TEAP at a concentration of $5\times10^{-2}$ mol·$l^{-1}$, with a scan rate of 50 mV/s.

The best results (maximum area of the low-energy peak) were obtained for a switching potential of −2.4 V/($Ag^+$/Ag) that is to say at the beginning of the operation for reducing the molecule (see the appended FIG. 10).

The very low mid-height width indicates an unambiguous structure, reflecting grafting perpendicular to the surface rather than flat.

It should be noted that the peak of the N 1s nitrogen (in the case of crotononitrile) exhibits a low energy structure at approximately 397.5 eV, which reflects a strong interaction between the metal and the nitrogen.

Finally, the results show that there does not exist a contribution from TEAP in the low binding energy peak, in view of the marked difference in the reduction potentials between the two molecules (see the appended FIG. 10).

The area of the C 1s signal is 1794, to be compared with 610 on a surface before electrochemistry. The area which can be assigned to the crotononitrile is thus approximately 1184. The area of the N 1s nitrogen is 231 (corrected for the sensitivity factor); there thus exists a C/N ratio of 1184/231=5.1, for a theoretical ratio of 4. A slight substoichiometry of nitrogen is thus recorded. The calculation of the percentage of carbon grafted with respect to the area corrected for the contamination then gives 9.3%. Among 11 carbon atoms added by electrochemistry, 1 carbon is chemically bonded to the metal. This result is in good agreement with the results (theoretical and experimental) cited in the paper by Bureau C. et al., 1999 (above-mentioned), where it had been shown that, in solution, the predominant entity formed is a dimer, which thus represents 1 grafted carbon from 8, fairly close to the experimental value obtained above (9.3%).

By way of comparison, XPS spectrometry of the surface of a sample obtained during the experiments carried out according to the conditions described in the paper by Bureau C. et al., 1999, (abovementioned) was performed and the spectrum obtained (not represented) allows it to be concluded that, in this case, an ultrathin homogeneous film had not been formed.

Figure 3:
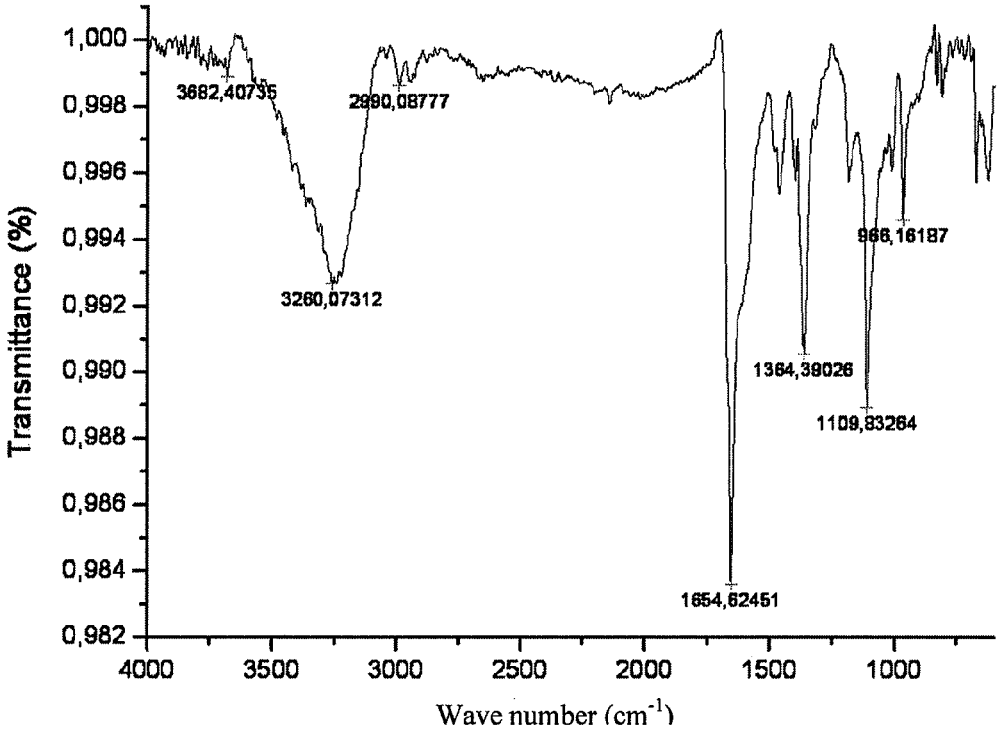
FIG. 3 (transmittance (%) as a function of the wavenumber in $cm^{-1}$) represents an infrared reflection-absorption spectrum (IRRAS), angle of incidence 85°, 256 scans, resolution 2 $cm^{-1}$, recorded on a nickel substrate after formation of an organic film from an electrolytic solution including crotononitrile.

2) Infrared Analysis (FIG. 3)

The intense absorption band at approximately 1655 $cm^{-1}$ with a shoulder at approximately 1615 $cm^{-1}$ indicates the presence of double bonds. The band centred on 966 $cm^{-1}$ indicates trans-disubstitution; that at approximately 700 $cm^{-1}$ indicates cis-disubstitution. The absence of the nitrile band at 2250 $cm^{-1}$ is noticed; there exists, in this region, only a small band centred on 2100 $cm^{-1}$. The latter can be assigned to a nitrile group interacting with a metal. The bands characteristic of double bonds can be explained by the presence of an imine group HN═C— and/or by the possible presence of starting molecules adsorbed on the surface.

This analysis confirms the XPS analysis, in which a substoichiometry of nitrogen and a strong interaction between the metal and the nitrogen had been recorded.

It is also possible to imagine that a portion of the nitrile groups (those not bonded to the metal) are parallel to the metal surface and do not absorb in IRRAS.

3) Study of the Variation in the XPS Spectrum as a Function of the Number of Cycles and of the Voltammetry And Monitoring of the Homogeneity of the Grafting As was explained above, generally, the synthesis of electrografted organic films is directed via parameters which can be adjusted in electrochemistry. The main parameters are the initial concentration of electroactive entities (compounds of formula (I)), the value of the maximum potential imposed and the polarization time, it being possible for the last parameter to vary either directly, it is the time for an electrolysis, or via a scan rate in voltammetry.

Only the study of the parameters of maximum potential and of polarization time has been presented in this example.

Figure 4:
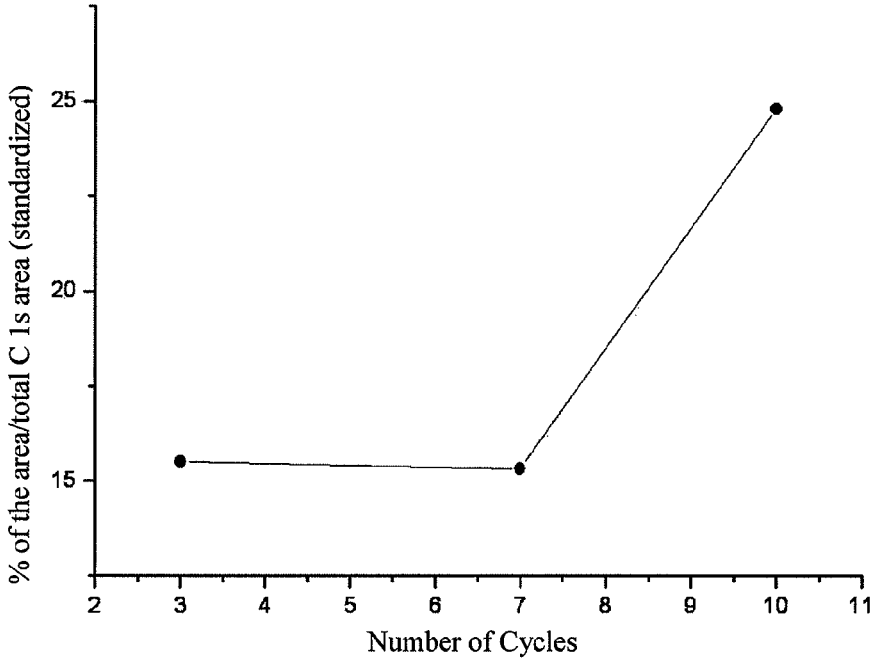
FIG. 4 represents the variation in the percentage of the total C 1s area (standardized) of an XPS spectrum recorded on a nickel substrate during cyclic voltammetry starting from a 5M crotononitrile solution between the equilibrium potential of the electrolysis cell (situated at approximately −0.6 and −2.4 V/($Ag^+$/Ag)), at the scan rate of 50 mV/s, as a function of the number of cycles carried out.

The study of the variation in the number of cycles, illustrated by the appended FIG. 4, in cyclic voltammetry, corresponds to a study of the polarization time. The best results are obtained for a large number of cycles. In this case, an increase in the relative percentage of the area of the C 1s peak is observed. Consequently, it may be said that the grafting should increase with the number of cycles.

Figure 5:
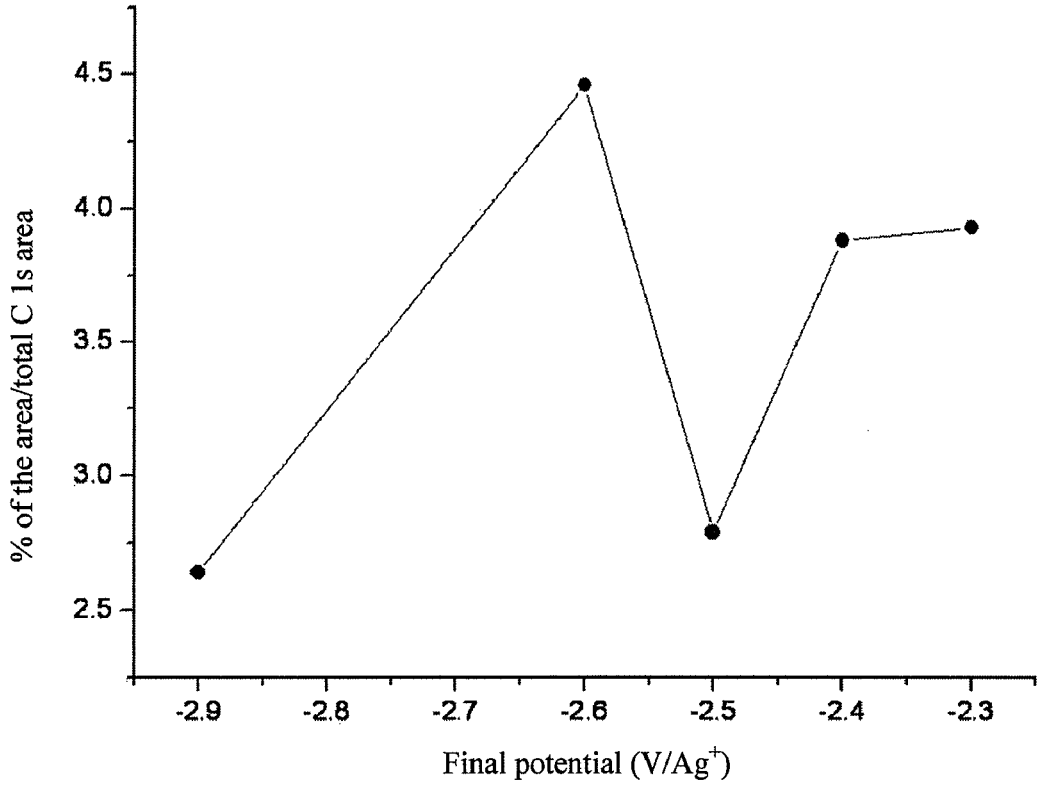
FIG. 5 represents the variation (in %) of the total C 1s area (standardized) of an XPS spectrum recorded on a nickel substrate during cyclic voltammetry (three cycles) as a function of the final potential (V/$Ag^+$) and starting from a 5M crotononitrile solution, at the scan rate of 50 mV/s, between the equilibrium potential of the electrolysis cell (situated at approximately −0.6 V/($Ag^+$/Ag)) and the final potential.

The study of the variation in the switching potential (or maximum potential imposed at the electrode) is illustrated in FIG. 5. It makes it possible to determine the optimum potential for obtaining a maximum for relative percentage of the area of the C 1s peak and thus optimization of the grafting. The area increases as a function of the final potential to reach a maximum at approximately −2.6 V/($Ag^+$/Ag).

It emerges from these two studies that the quality of the grafting can be effectively controlled by varying the appropriate parameters, such as the number of cycles and the maximum potential imposed.

Figure 11:
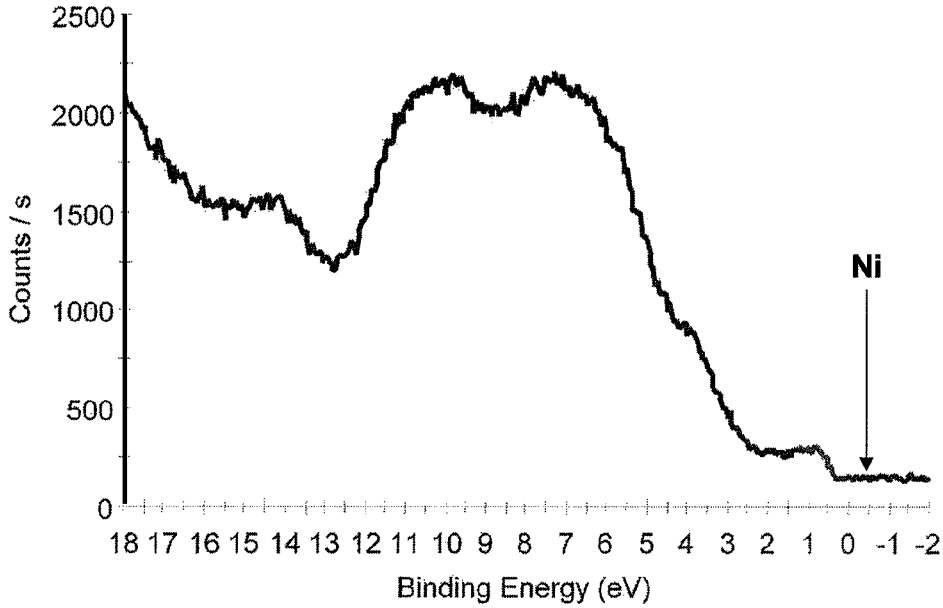
FIG. 11 (same units as FIG. 1) represents a UPS (HeII) (ultraviolet photoelectron spectroscopy) spectrum recorded on a nickel substrate after formation of an organic film from an electrolytic solution including crotononitrile (5 M)
Figure 12:
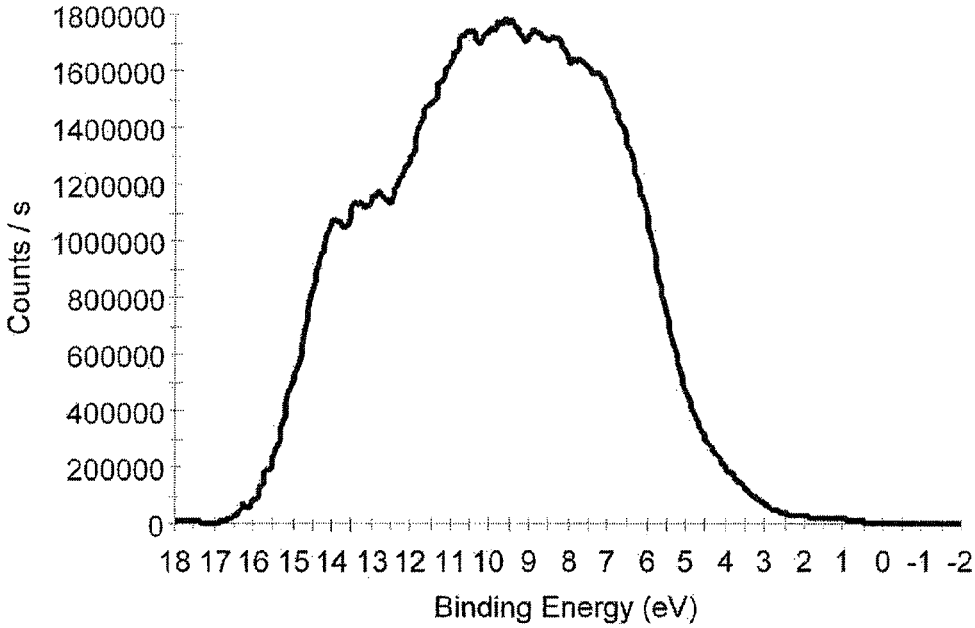
FIG. 12 (same units as FIG. 1) represents a UPS (HeI) spectrum recorded on a nickel substrate after formation of an organic film from an electrolytic solution including crotononitrile (5 M).

Furthermore, in order to monitor the homogeneity of the film, HeI and HeII ultraviolet photoelectron spectroscopy (UPS) analyses were carried out. In the UPS (HeII) spectrum, the presence of a band corresponding to nickel is observed (FIG. 11). Two interpretations appear possible: either a homogeneous film with a thickness of less than 1.5 nm has been obtained (mean depth of penetration) or a nonhomogeneous film exhibiting islets has been formed. The spectrum obtained by UPS (HeI) spectrometry (mean depth of penetration less than that of HeII) makes it possible to remove the doubt (FIG. 12). This is because in this case the signal corresponding to the metal is found to disappear, which means that a homogeneous film has indeed been obtained and that its thickness is between 0.7 and 1.5 nm.

Example 2

Synthesis of an Ultrathin Organic Film Grafted to a Nickel Substrate Starting from Ethyl Trans-Crotonate This example corresponds to the study of ethyl trans-crotonate (compound represented below), a molecule carrying a motor for anionic polymerization (in this instance an ester group) and a polymerization inhibitor (the $CH_3$ group).

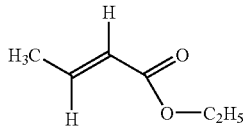

The experiments were carried out under conditions strictly identical to those presented above in Example 1 and the surfaces after electrochemistry were, as above, analysed by XPS and IRRAS. The results are presented in FIGS. 6 and 7 respectively.

1) XPS Analysis

Figure 6:
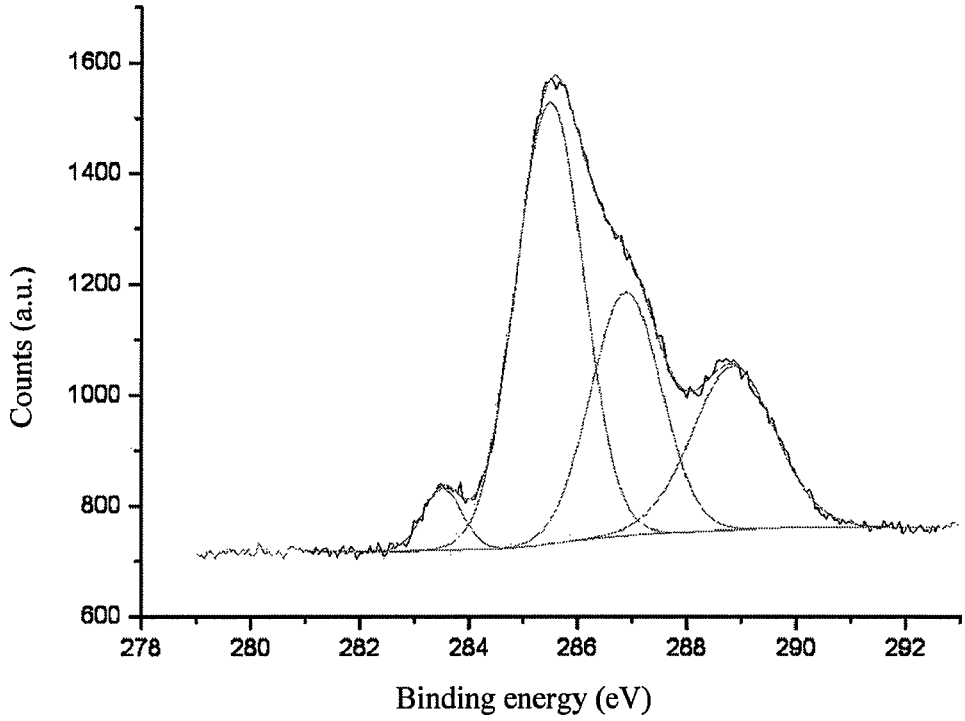
FIG. 6 (same units as FIG. 1) represents the XPS spectrum of the region of the C 1s levels recorded on a nickel substrate after formation of an organic film from an electrolytic solution including ethyl crotonate (5 M)

In FIG. 6, it may be seen that the first peak is centred on 283.5 eV, the mid-height width is 0.85 eV and it represents, by area, 3.85% of the total C 1s envelope. This peak is assigned to the carbon atoms chemically bonded to the metal atoms. The presence of this peak proves the electrochemical grafting of the ethyl crotonate molecule to the nickel surface.

The best results (maximum area of the low-energy peak) are obtained for a switching potential of −2.4 V/($Ag^+$/Ag), that is to say at the beginning of the operation for reducing the molecule (see the appended FIG. 10). The best results are also obtained for a large number of cycles. In this case, the overall C 1s area is observed to be stable. There is no masking of the interface, as in the case of polymerization. Consequently, the grafting should increase with the number of cycles.

The area of the C 1s signal is 2622, to be compared with 610 on a surface before electrochemistry. The area which can be assigned to the ethyl crotonate is thus approximately 2012. The area of the O 1s oxygen is 1590 (corrected for the initial oxidation and for the sensitivity factor); there thus exists a C/O ratio of 2012/1590=1.3, for a theoretical ratio of 3. An over-oxidation of the surface is thus found. The calculation of the percentage of grafted carbon with respect to the area corrected for the contamination gives 5%. Among 20 carbon atoms added by electrochemistry, 1 is chemically bonded to the metal. This result may thus correspond to grafted trimers.

Figure 7:
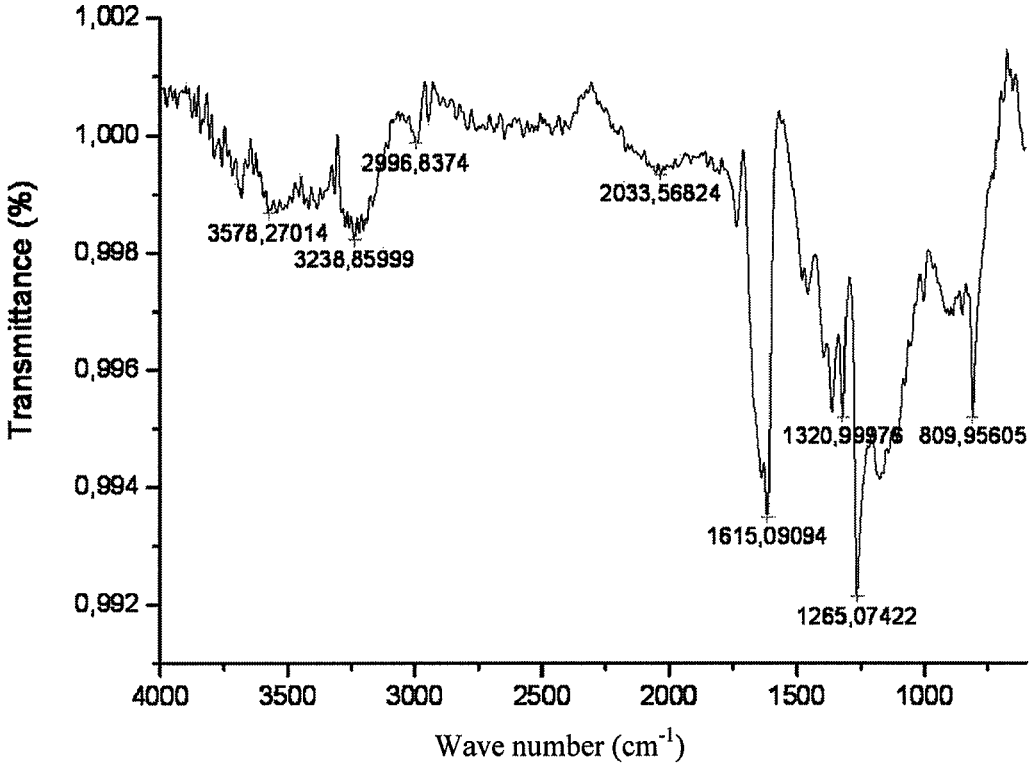
FIG. 7 (transmittance (%) as a function of the wavenumber in $cm^{-1}$) represents an IRRAS spectrum, angle of incidence 85°, 256 scans, resolution 2 $cm^{-1}$, recorded on a nickel substrate after formation of an organic film from an electrolytic solution including ethyl crotonate (5 M)

2) Infrared Analysis (FIG. 7)

In FIG. 7, it may be observed that the signal is very weak (transmittance of less than 1%); the IRRAS technique is at the detection limit here. The spectrum is difficult to interpret. However, it is possible to detect the ester group by its characteristic bands centred on 1710, 1265 and 1200 $cm^{-1}$. The weakness of the signal may indicate the presence of a strong orientation of the grafted chains with the absorbent groups parallel to the metal surface. It should also be emphasized that the ester group is indeed present, which offers an excellent possibility of this layer being subsequently functionalized.

Example 3

Synthesis of an Ultrathin Organic Film Grafted to a Nickel Substrate Starting from Cis-2-Pentenenitrile This example corresponds to the study of cis-pentenenitrile (compound represented below), a molecule carrying a motor for anionic polymerization (in this instance a nitrile group) and a polymerization inhibitor (the $CH_2$ group carried by the ethylenic carbon).

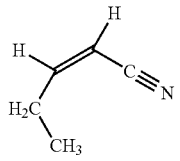

The experiments were carried out as described above in Example 1 and the surfaces, after electrochemistry, were, as above, analysed by XPS and IRRAS. The results are presented in FIGS. 8 and 9 respectively.

Figure 8:
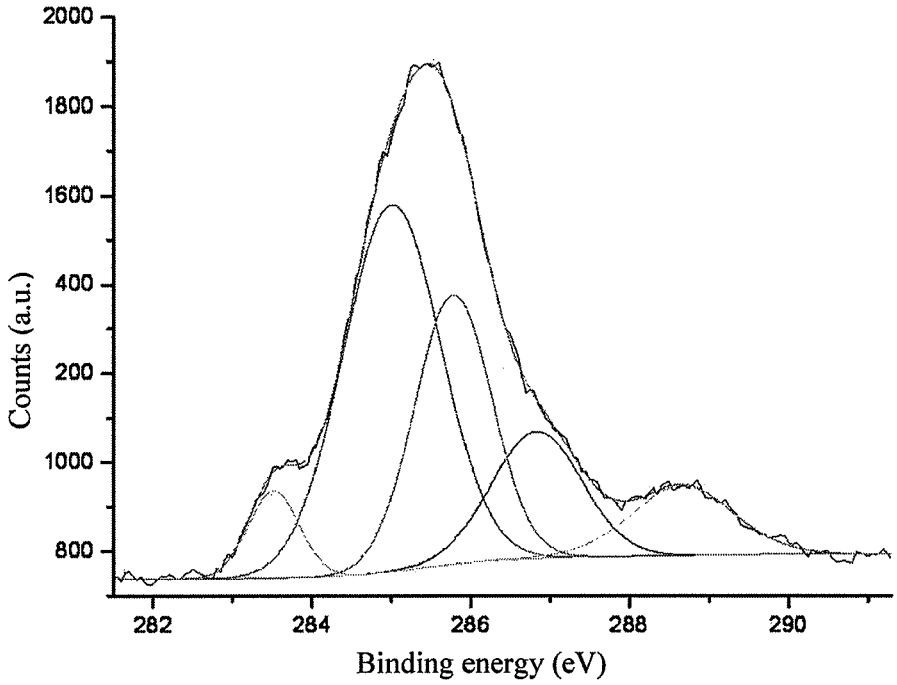
FIG. 8 (same units as FIG. 1) represents the XPS spectrum of the region of the C 1s levels recorded on a nickel substrate after formation of an organic film from an electrolytic solution including cis-pentenenitrile (5 M)

1) XPS Analysis (FIG. 8)

In this figure, the first peak is centred on 283.5 eV, the mid-height width is 0.77 eV and it represents, by area, 5.6% of the total C 1s envelope. This peak is assigned to the carbon atoms chemically bonded to the metal atoms. The presence of this peak again proves the electrochemical grafting of the pentenenitrile molecule to the nickel surface. The extremely small mid-height width here again reflects an unambiguous structure.

The best results (maximum area of the low-energy peak) are obtained for a switching potential of −2.4 and −2.5 $V/(Ag^+/Ag)$, that is to say at the beginning of the operation for reducing the molecule. As regards the number of cycles, in this case the C 1s area is found to be stable, this stability being attributed to the interfacial bonding. On the other hand, there is a slight increase in the overall C 1s and N 1s areas, reflecting an increase in the thickness of the layer, the latter, however, not exceeding 3 nanometers (evaluated by virtue of the ratio of the areas of the XPS C 1s and Ni 2p3/2 peaks).

The area of the C 1s signal is 2830, to be compared with 610 on a virgin surface before electrochemistry; there thus exists approximately 2220 of area which can be assigned to the pentenenitrile. The area of the N is nitrogen is 855 (corrected for the sensitivity factor); there thus exists a C/N ratio of 2220/855=3, for a theoretical ratio of 5. Carbon is thus found to be in substoichiometry in the layer. The calculation of the percentage of grafted carbon with respect to the area corrected for the contamination gives 7.2%. Among 14 carbon atoms added by electrochemistry, 1 is chemically bonded to the metal. This result may thus correspond to grafted trimers.

Figure 9:
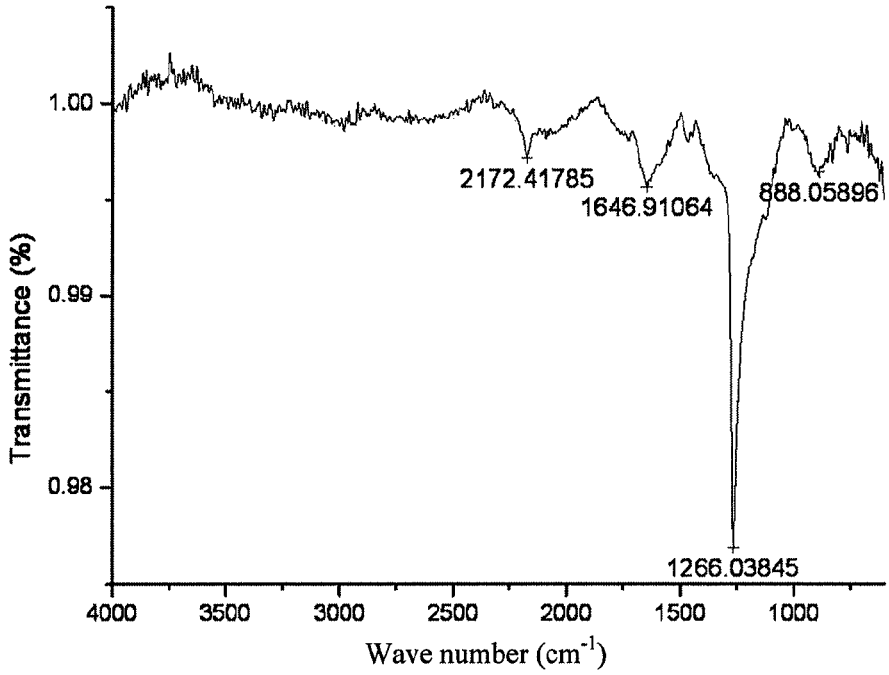
FIG. 9 (transmittance (%) as a function of the wavenumber in $cm^{-1}$) represents an IRRAS spectrum, angle of incidence 85°, 256 scans, resolution 2 $cm^{-1}$, recorded on a nickel substrate after formation of an organic film from an electrolytic solution including cis-pentenenitrile (5 M)

2) Infrared Analysis (FIG. 9)

In this figure, the broad absorption band at approximately 1647 $cm^{-1}$ indicates the presence of a double bond which may correspond to the formation of imine groups —CH═NH. The absence of the nitrile band at 2240 $cm^{-1}$ is noticed; there exists, in this region, only a band centred on 2170 $cm^{-1}$. The latter can be assigned to a nitrile group interacting with a metal. This analysis is in disagreement with the XPS analysis, where carbon was recorded as being in substoichiometry. The nitrile groups thus either interact strongly with the metal (as seen by XPS and by IRRAS) or are parallel to the metal surface and do not absorb in IRRAS. The strong band at 1265 $cm^{-1}$ may correspond to a structure of —CH═NH type interacting with the metal of the electrode. As in the preceding examples, the weakness of the signal may indicate the presence of a strong orientation of the grafted chains with the absorbent groups parallel to the metal surface.

The invention claimed is:

1. A process for the formation of a homogeneous organic film on an electrically conducting or semiconducting surface, comprising electrochemically grafting on the electrically conducting or semiconducting surface at least one organic precursor of the following formula (I):

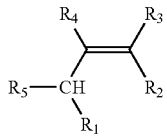

(I)

independently of E or Z configuration, in which:

$R_2$ is an electron-withdrawing group, $R_1$, $R_3$, $R_4$ and $R_5$, which are identical or different, represent a hydrogen atom, an alkyl radical or an aryl radical to form a homogeneous organic film.

2. The process according to claim 1, wherein the said organic film has a thickness of less than or equal to 10 nm.

3. The process according to claim 1, wherein $R_2$ is a nitrile or a carbonyl group.

4. The process according to claim 3, wherein $R_2$ is a carbonyl group chosen from esters, carboxylic acids, acid halides and acid anhydrides.

5. The process according to claim 1, wherein an electrolytic solution composed of at least one solvent and comprising at least one compound of formula (I) is electrolysed on said surface at least a working potential which is more cathodic than the electroreduction potential of at least one of the said precursors of formula (I), the said potentials being measured with respect to the same reference electrode, until a homogeneous electrografted organic film is obtained.

6. The process according to claim 5, wherein the said organic film exhibits a thickness of less than or equal to 10 nm.

7. The process according to claim 5, wherein the precursors of formula (I) are chosen from the compounds for which the pKa of the hydrogen of the carbon carrying $R_1$ and $R_5$ is less than the pK of the solvent of the electrolytic solution, K being the autoprotolysis constant of the solvent.

8. The process according to claim 5, wherein the electrically conducting or semiconducting surface is chosen from stainless steel, steel, iron, copper, nickel, cobalt, niobium, aluminium, silver, titanium, silicon, titanium nitride, tungsten, tungsten nitride, tantalum, tantalum nitride and noble metal surfaces composed of at least one metal chosen from gold, platinum, iridium and platinum iridium.

9. The process according to claim 8, wherein the electrically conducting or semiconducting surface is a nickel surface.

10. The process according to claim 5, wherein the working potential is at most greater by 5% than the value of the reduction potential of at least one of the said precursors of formula (I) present in the electrolytic solution.

11. The process according to claim 5, wherein the working current density is less than or equal to $10^{-4}$ A·cm$^{-2}$.

12. The process according to claim 5, wherein the electrolysis of the electrolytic solution is carried out by polarization under linear or cyclic voltammetry conditions, under potentiostatic, potentiodynamic, galvanostatic or galvanodynamic conditions or by simple or pulse chronoamperometry.

13. The process according to claim 12, wherein the electrolysis of the electrolytic solution is carried out by polarization under cyclic voltammetry conditions.

14. The process according to claim 5, wherein, in the electrolytic solution, the concentration of the precursor or precursors of formula (I) is between 0.001 and 10 mol·l$^{-1}$.

15. The process according to claim 5, comprising an additional stage of functionalization of the electrografted organic film.

16. The process according to claim 5, wherein the solvents of the electrolytic solution are chosen from dimethylformamide, ethyl acetate, acetonitrile, dimethyl sulphoxide and tetrahydrofuran.

17. The process according to claim 5, wherein the electrolytic solution additionally includes at least one supporting electrolyte.

18. An electrically conducting or semiconducting surface comprising at least one face at least partially covered with an electrografted homogeneous organic film of at least one precursor of the following formula (I):

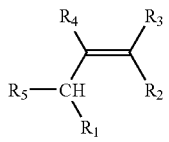

(I)

independently of E or Z configuration, and in which $R_2$ is an electron-withdrawing group, and $R_1$, $R_3$, $R_4$ and $R_5$, which are identical or different, represent a hydrogen atom, an alkyl radical or an aryl radical.

19. A surface according to claim 18, wherein the homogeneous organic film exhibits a thickness of between 1 and 15 monomers resulting from at least one compound of formula (I).

20. A surface according to claim 18, wherein the homogeneous organic film exhibits a thickness of between 0.2 and 2.5 nm.

21. A microelectronic component comprising at least one surface as defined in claim 18.

22. A biomedical device comprising at least one surface as defined in claim 18.

23. A process for the formation of a homogeneous organic film on an electrically conducting or semiconducting surface, comprising electrochemically grafting on the electrically conducting or semiconducting surface at least one organic precursor of the following formula (I):

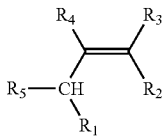

(I)

independently of E or Z configuration, in which:

$R_2$ is an electron-withdrawing group, $R_1$, $R_3$, $R_4$ and $R_5$, which are identical or different, represent a hydrogen atom, an alkyl radical or an aryl radical to form a homogeneous organic film; wherein, the precursor or precursors of formula (I) are chosen from crotononitrile, pentenenitrile, ethyl crotonate and their derivatives.

* * * * *

UNITED STATES PATENT AND TRADEMARK OFFICE

CERTIFICATE OF CORRECTION

PATENT NO. : 8,288,009 B2
APPLICATION NO. : 11/908692
DATED : October 16, 2012
INVENTOR(S) : Deniau et al.

It is certified that error appears in the above-identified patent and that said Letters Patent is hereby corrected as shown below:

Columns 3 and 4,

"Scheme A" should appear as indicated below with the headings moved below the reaction formula.

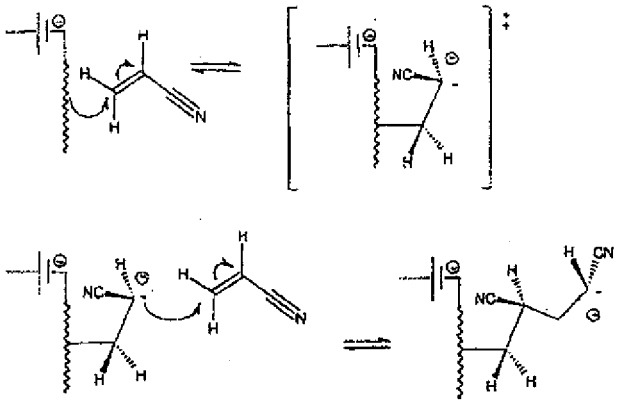

1: Surface chemical reaction, grafting

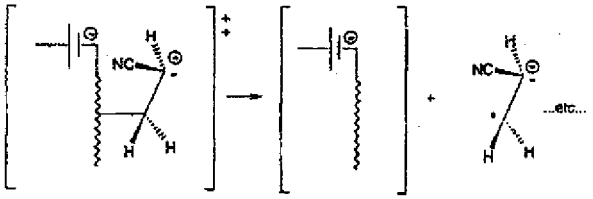

2: Desorption, solution polymerization

Signed and Sealed this
Fifth Day of March, 2013

Teresa Stanek Rea
*Acting Director of the United States Patent and Trademark Office*